United States Patent [19]

Tegel, deceased et al.

[11] Patent Number: 5,062,345

[45] Date of Patent: Nov. 5, 1991

[54] CAP FOR A ROCKET EXIT OPENING

[75] Inventors: Marek Tegel, deceased, late of Wedel, by Anita Tegel, heir; Dieter Wenzel, Haseldorf, all of Fed. Rep. of Germany

[73] Assignee: DMT Marinetechnik GmbH, Hamburg, Fed. Rep. of Germany

[21] Appl. No.: 623,768

[22] Filed: Dec. 7, 1990

[30] Foreign Application Priority Data

Dec. 7, 1989 [DE] Fed. Rep. of Germany ..... 3940468

[51] Int. Cl.[5] ..... F41F 3/077

[52] U.S. Cl. ..... 89/1.817; 89/1.810

[58] Field of Search ..... 89/1.817, 1.810, 1.809

[56] References Cited

U.S. PATENT DOCUMENTS

| | | | |
|---|---|---|---|
| 2,609,730 | 9/1952 | Bergström | 89/1.817 |
| 3,135,163 | 6/1964 | Mechlin et al. | 89/1.817 |
| 3,137,203 | 6/1964 | Brown | 89/1.810 |
| 3,140,638 | 7/1964 | De Luca | 89/1.817 |
| 3,362,291 | 1/1968 | De Luca | 89/1.817 |
| 3,962,951 | 6/1976 | Schenk | 89/1.810 |
| 3,970,006 | 7/1976 | Copeland et al. | 89/1.817 |
| 4,301,708 | 11/1981 | Mussey | 89/1.817 |
| 4,498,368 | 2/1985 | Doane | 89/1.817 |

FOREIGN PATENT DOCUMENTS

| | | |
|---|---|---|
| 252072 | 2/1967 | Austria . |
| 2419348 | 10/1975 | Fed. Rep. of Germany . |

*Primary Examiner*—David H. Brown

*Attorney, Agent, or Firm*—Spencer & Frank

[57] ABSTRACT

A cap for a rocket exit opening of a mobile rocket launcher for a submarine which is guided to the surface of the water in order to launch an air rocket which pushes out the cap when it is launched. The cap includes pressed together cap segments for covering the exit opening of the mobile rocket launcher. The cap segments are shaped so that externally applied force components which are radial with respect to the longitudinal axis of the submarine act on the segments. The cap segments present a peripheral edge which cooperate with the peripheral edge of the exit opening to form a form locking plug-in connection with one another which is held together by external force components acting in the axial direction of the submarine. A tear-away, pressure resistant, slightly elastic and watertight, thin sheet adapted for attachment to the submarine is stretched over the cap segments when it is attached to the submarine.

6 Claims, 4 Drawing Sheets

CAP FOR A ROCKET EXIT OPENING

BACKGROUND OF THE INVENTION

The present invention relates to a cap for a rocket exit opening of a mobile rocket launcher, wherein the cap is pushed out of the exit opening by the rocket.

German Offenlegungsschift [laid-open patent application] No. 2,419,348 discloses the use of an elastic cover pressed into an annular groove mount to cover a rocket exit opening of a mobile rocket launcher, wherein the cover is pressed out of its mount by the starting rocket. Austrian Patent No. 252,072 additionally discloses for this purpose the use of thin sheets which are torn by the starting rocket, thus releasing the exit opening. Neither of these prior art covers can be used in submarines because of the external action of the water pressure.

SUMMARY OF THE INVENTION

It is an object of the present invention to provide a pressure resistant cover for a rocket exit opening in a submarine where such a cover is removed automatically by the starting rocket.

The above and other objects are accomplished in accordance with the invention by the provision of a cap for a rocket exit opening of a mobile rocket launcher for a submarine which is guided to the surface of the water in order to launch an air rocket which pushes out the cap when it is launched, wherein the exit opening presents a peripheral edge, the cap comprising: pressed together cap segments for covering the exit opening of the mobile rocket launcher, the cap segments being shaped so that externally applied force components which are radial with respect to the longitudinal axis of the submarine act on the segments, the cap segments presenting a peripheral edge which cooperates with the peripheral edge of the exit opening to form a form locking plug-in connection with one another which is held together by external force components acting in the axial direction of the submarine; and a tear-away, pressure resistant, slightly elastic and watertight, thin sheet adapted for attachment to the submarine and being stretched over the cap segments when it is attached to the submarine.

The cap according to the invention has the advantage that the use of complicated slides or valves is not required, although the openable cap must be able to withstand heavy water pressures. By adhering to the principle of automatic opening of the cap by the starting rocket, expensive time controls or mechanical opening controls are not needed. The use of the thin, tear-away sheet holds the cap segments together in a simple manner at low water pressures, as well as in the absence of water pressure, and ensures the water-tightness of the cap without requiring additional seals.

One embodiment of the invention will be described in greater detail with reference to the drawing figures.

DETAILED DESCRIPTION OF THE PREFERRED EMBODIMENT

Figure 1:
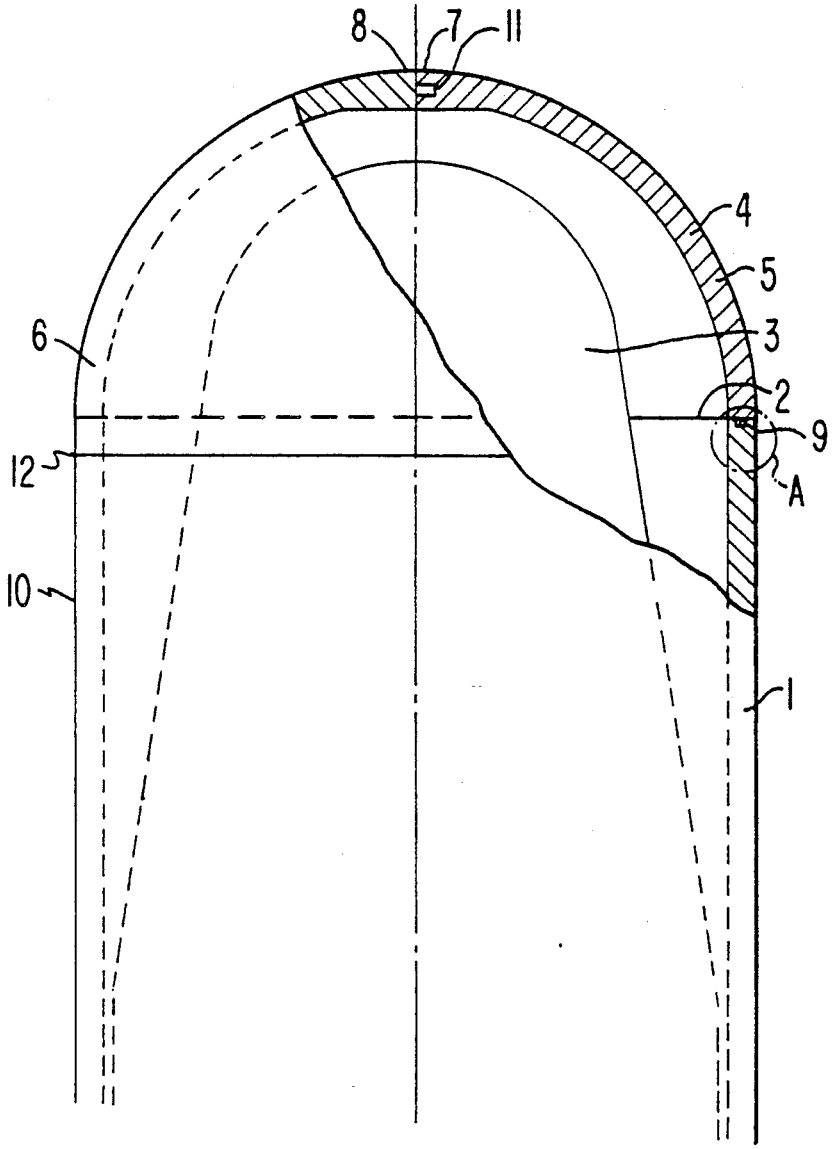
FIG. 1 is a schematic side view in partial section which shows a launch tube with a cap according to the invention, which may be used with a submarine.

Referring to FIG. 1, there is shown a launch tube of a submarine 1 which is equipped with an air rocket 3. A cap 4 covers a rocket launcher exit opening 2 and is composed of two cap segments 5 and 6, a thin sheet 10 and an explosive charge 11.

Figure 2:
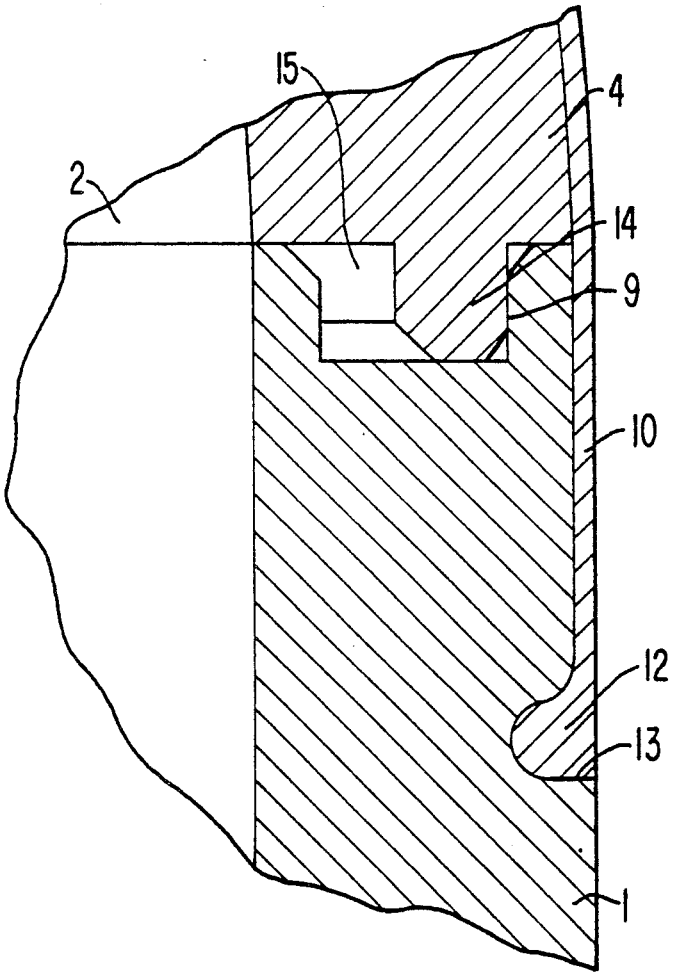
FIG. 2 is an enlargement showing greater detail of the plug-in connection between cap and submarine within circle A in FIG. 1.

In an assembled state, cap 4 forms a hemispherical shell. The peripheral edge of cap 4 and the facing peripheral edge of exit opening 2 form a plug-in connection 9 which is configured as a tongue-and-groove system as indicated by detail "A" of FIG. 1, an enlargement of which is shown in FIG. 2. Plug-in connection 9 is held together by externally applied axial forces acting on cap 4. The axial direction of the action is here understood to mean action in the direction of the longitudinal axis 12 of submarine 1. Plug-in connection 9 fixes cap 4 on the edge of exit opening 2 and holds cap segments 5 and 6 together at the inserted edge. Cap segments 5 and 6 have abutting edges 7 and 8, respectively, which are pressed together by radial force components which act on the cap from the outside. The axial and radial forces acting on cap 4 are generated either by the external water pressure and/or by the tensioned thin sheet 10. In order for forces having radial force components to be able to act on cap 4, the shape of cap 4 must differ from the shape of a planar cover. Any other desired cap shapes except for the planar shape would, as an alternative to the hemispherical shape shown here, also solve the problem at hand. For example, cap 4 may also have the shape of a paraboloid of revolution.

Thin sheet 10 is composed of a tear-away, pressure resistant, slightly elastic and watertight material and is stretched over the attached cap 4. Thin sheets having the above-mentioned physical material properties are available on the market as products customary in the trade. When thin sheet 10 is stretched over cap 4 it holds cap 4 together and over exit opening 2, even if there is no external water pressure, for example on the surface of the water. Moreover, the tearability of thin sheet 10 permits the two cap segments 5 and 6 to be driven apart by the starting air rocket 3 if the submarine is located at the surface of the water. Moreover, thin sheet 10 stretched over cap 4 also makes the attached cap 4 watertight.

Desirably, an explosive charge 11, which is detonated upon impact by the head of the lifted rocket 3, is integrated in the edge of one of the cap segments, for example edge 7 of cap segment 5, at the tip of the cap to support the driving apart of cap segments 5 and 6 during launching of the rocket 3.

FIG. 2 is an enlargement of detail "A" of FIG. 1 where the form locking plug-in connection 9 is formed between cap 4 and exit opening 2. This connection is composed of a tongue-and-groove joint with a tongue element 14 which is disposed circumferentially around the edge of segments 5 and 6 and a circumferential groove 15 in the edge surrounding exit opening 2. Also visible is thin sheet 10 which is stretched over cap 4 and which has at its edge a shaped-on bead 12 that snaps into an annular groove 13 provided in the outer surface of the submarine. Annular groove 13 is disposed in a position which permits the necessary tensioning of thin sheet 10 after it has been pulled over the attached cap 4.

Sheet 10 is fabricated out of suitable thermoplastics. Any other tear-away, pressure resistant, slightly elastic and watertight material also solves the problem at hand. Cap segments 5 and 6 are fabricated of material corresponding to the material of the shell of submarine 1, for example. Cap segments fabricated out of other materials may also meet the teachings of the invention.

Figure 3:
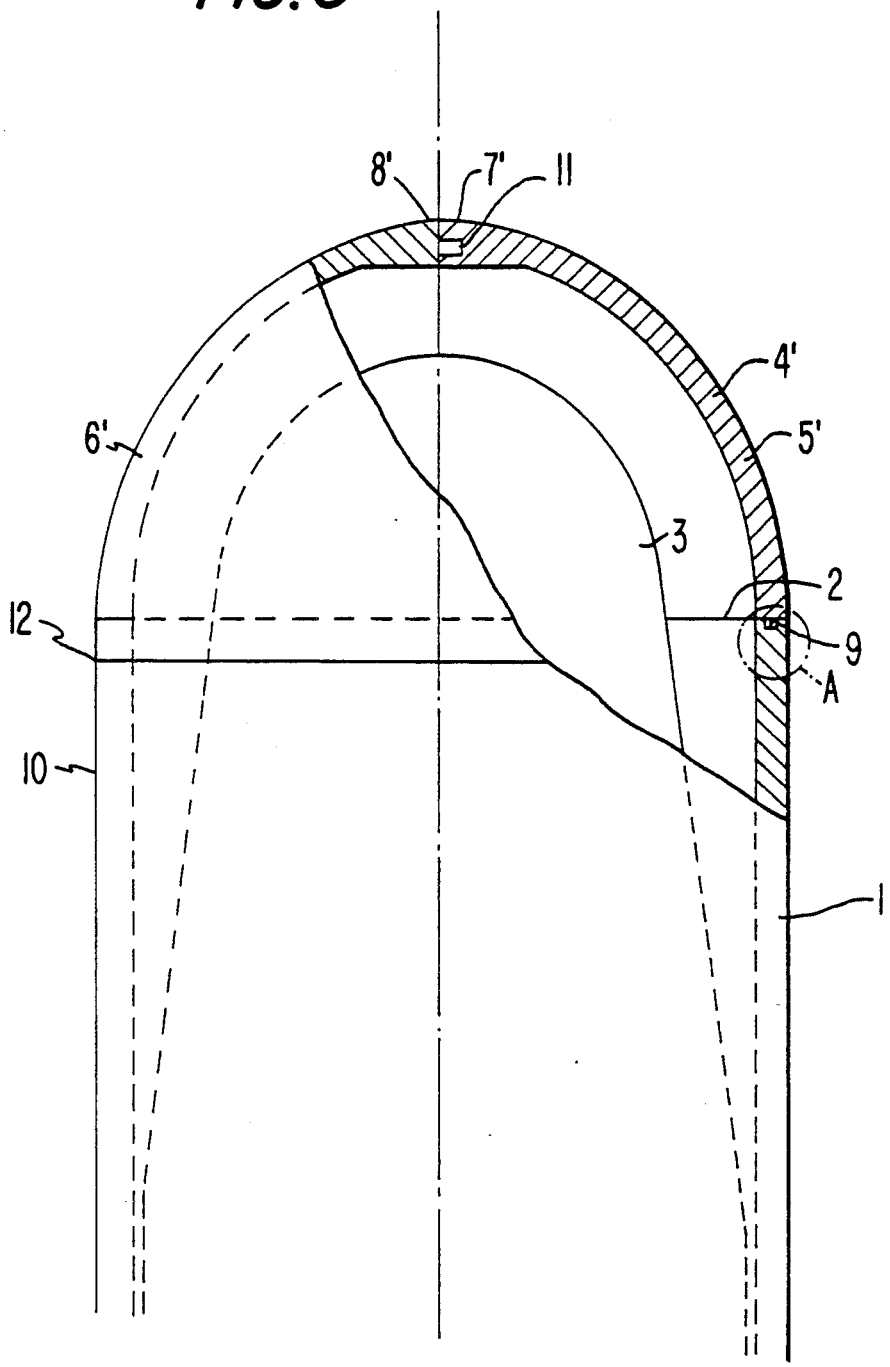
FIG. 3 shows a cap which forms a paraboloid of revolution.
Figure 4:
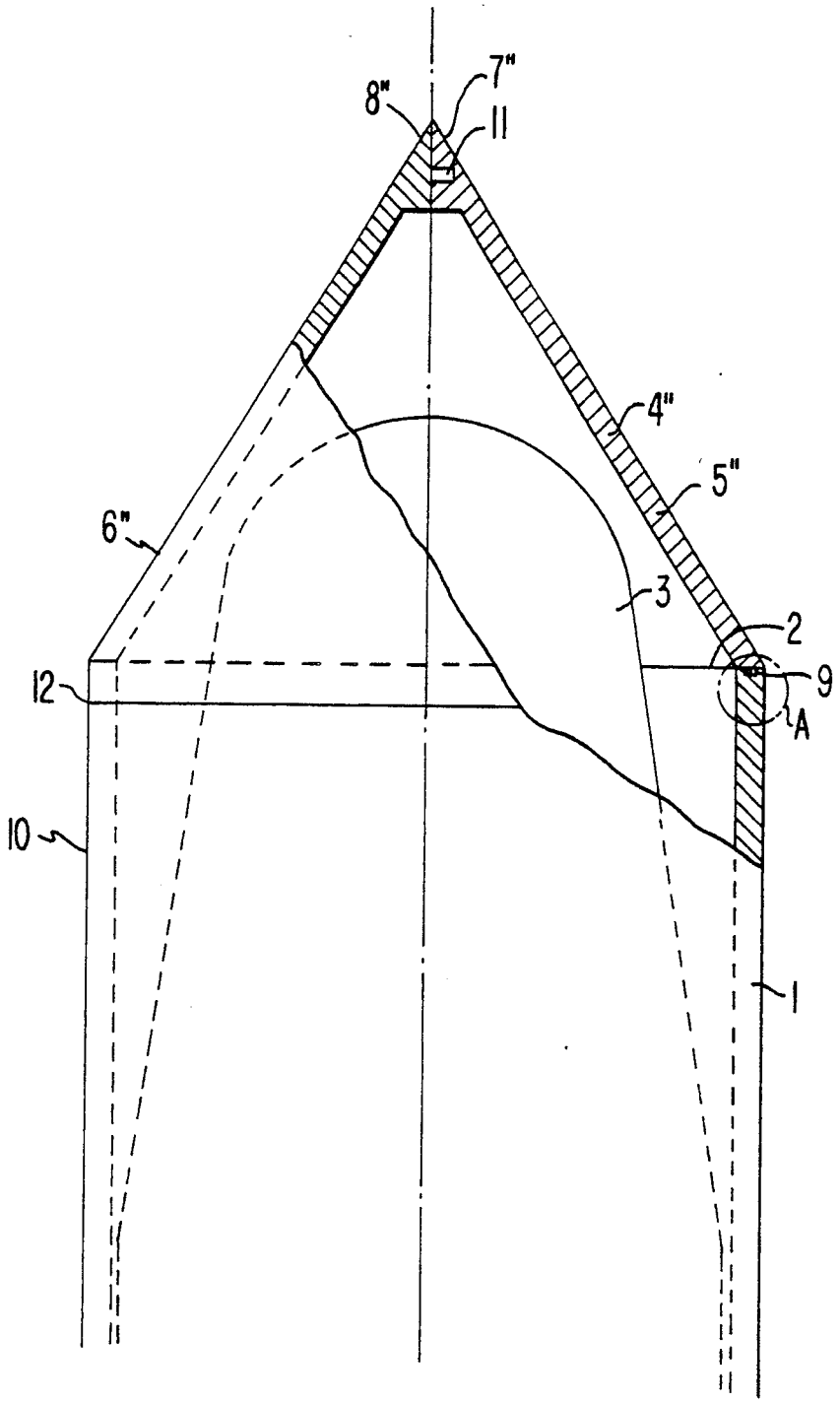
FIG. 4 shows a cap which forms a tip of a cone.

FIG. 3 and FIG. 4 each slow a launch tube of a submarine 1 which covers all features of the launch tube shown in FIG. 1 and recited here before with the exception of a varying form of the cap. The cap shown in FIG. 1 forms a hemisphere, the cap of FIG. 3 forms a paraboloid of revolution, and the cap of FIG. 4 forms a tip of a cone. Reference numerals 4', 5', 6', 7', and 8' in FIG. 3 and reference numerals 4'', 5'', 6'', 7'' and 8'' in FIG. 4 identify parts which generally correspond with parts identified by reference numerals 4, 5, 6, 7, and 8 in FIG. 1.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A cap for a rocket exit opening of a mobile rocket launcher for a submarine which is guided to the surface of the water in order to launch an air rocket which pushes out the cap when it is launched, wherein the exit opening presents a peripheral edge, comprising:

pressed together cap segments for covering the exit opening of the mobile rocket launcher, said cap segments being shaped so that externally applied force components which are radial with respect to the longitudinal axis of the submarine act on said segments, said cap segments presenting a peripheral edge which cooperates with the peripheral edge of the exit opening to form at least partly a form locking plug-in connection with one another which is held together by external force components acting in the axial direction of the submarine; and a tear-away, pressure resistant, slightly elastic and watertight, thin sheet adapted for attachment to the submarine and being stretched over said cap segments when it is attached to the submarine.

2. A cap as defined in claim 1, wherein said pressed together cap segments form a hemisphere.

3. A cap as defined in claim 1, wherein said pressed together cap segments form a paraboloid of revolution.

4. A cap as defined in claim 1, wherein said pressed together cap segments form a tip of a cone.

5. A cap as defined in claim 1, wherein the submarine has an exterior wall provided with an annular groove, said sheet has an edge and a bead shaped on the edge of said sheet, and said sheet, when stretched over said cap segments, is held in place by said bead disposed in the annular groove.

6. A cap as defined in claim 1, wherein said cap segments have abutting edges which present a cap tip, and said cap further comprises a controllable explosive charge integrated in said cap tip in the abutting edge of one of said cap segment which is detonated upon impact by the head of the lifted rocket 3 to support a driving apart of said cap segments when an rocket is launched.

* * * * *